United States Patent [19]

Allard

[11] 4,430,767

[45] Feb. 14, 1984

[54] TECHNIQUES FOR STIFFENING SHOE INSOLES

[75] Inventor: Jules N. Allard, Tyngsboro, Mass.

[73] Assignee: Bush Universal, Inc., Woburn, Mass.

[21] Appl. No.: 236,569

[22] Filed: Feb. 20, 1981

[51] Int. Cl.[3] ..... A43D 31/00; A43B 13/41

[52] U.S. Cl. ..... 12/146 S; 12/21; 36/76 C; 264/223

[58] Field of Search ..... 12/146 S, 146 R, 146 B, 12/21, 22; 36/44, 43, 76 C, 76 R; 264/223

[56] References Cited

U.S. PATENT DOCUMENTS

| | | | |
|---|---|---|---|
| 3,398,221 | 8/1968 | Sherman et al. | 264/223 |
| 4,231,169 | 11/1980 | Toyama et al. | 12/146 S |
| 4,291,428 | 9/1981 | Anzani | 36/44 |

FOREIGN PATENT DOCUMENTS

| | | | |
|---|---|---|---|
| 307467 | 4/1930 | United Kingdom | 12/21 |
| 1572162 | 7/1980 | United Kingdom | 36/76 C |

*Primary Examiner*—James Kee Chi

*Attorney, Agent, or Firm*—Wolf, Greenfield & Sacks

[57] ABSTRACT

A system for stiffening the shank of an insole uses a stiffener which is formed from an initially flexible and deformable strip of thermosetting resin, preferably mixed with reinforcing fibers such as fiberglass. A length of such shank strip material is applied onto the bottom of an insole and the insole, with the shank strip in place, is mounted in a special fixture. The fixture holds the strip on the bottom of the insole and also assures that the insole and shank strip will be held in the proper configuration, with the proper bend at the ball and the arch. With the shank strip and insole so held an external stimulus, such as radiant heat, is applied to the shank strip to activate and cure it in place on the insole bottom. The fixture may be adjusted to provide precisely repeatable control over the curvature of the insole either to assure that the insole conforms precisely to the bottom of a particular last or to modify the curve at the insole bottom and configuration of the shank to suit any particular requirement of the manufacturer.

17 Claims, 11 Drawing Figures

Fig. 1
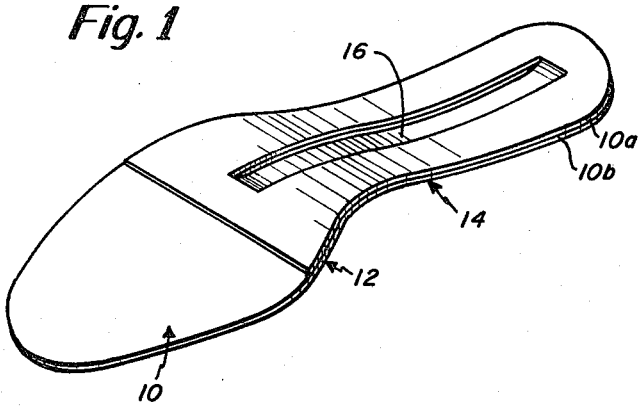
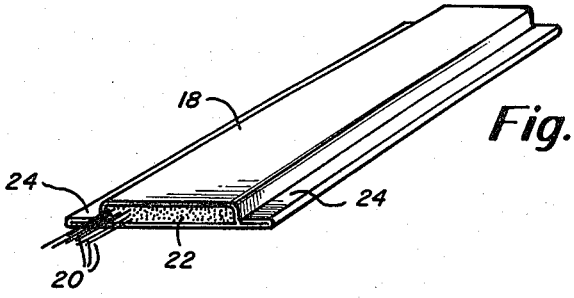
Fig. 2
Fig. 3
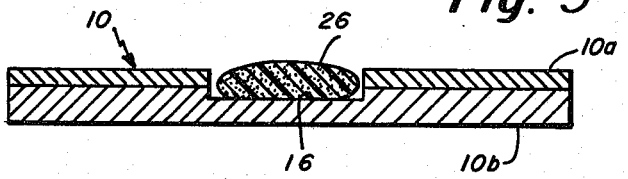

6
7
8
100
104
162
90
192
190
146
186
122
138
188
152
139
144
108
110
120
141
170
164
118
132
136
142
130
126
158
94
92
156
160
96

TECHNIQUES FOR STIFFENING SHOE INSOLES

BACKGROUND OF THE INVENTION

This invention relates to shoe manufacture and particularly to improvements in stiffening the shank region of a shoe insole.

It has been substantially universal practice for many decades to stiffen the shank region of a shoe by attaching a preformed steel, wood or like shank piece to the bottom of the insole. Depending on the particular shoe manufacturing process employed by the manufacturer, the shank may be applied before the insole is attached to any other portion of the shoe assembly or, in other instances, the shank may be attached to the insole as a subsequent step, after a substantial part of the shoe assembly already has been built up on a last.

Regardless of the manufacturing technique, the use of metal, wood or similar preformed shanks has caused numerous difficulties over the years. Substantial inventories of a wide variety of sizes and styles of shanks must be maintained. It is not uncommon for the shanks and shoes to be mismatched. Moreover, even when a proper shank piece is selected for a particular shoe, it is not uncommon for the shank piece, which often is simply stapled to the insole, to be misregistered on the insole. Preformed shanks must be placed on the insole in precisely the right location so that the curve of the shank will conform to the intended proper curve of the finished shoe. However, preformed shank pieces are difficult to place accurately and the operation requires significant operator skill. Failure to place the shank properly also may interfere with subsequent manufacturing operations, such as nailing the heel to the shoe.

Even when a preformed shank piece is assembled properly into a shoe difficulties can be presented when the shoe is worn. It is not uncommon for a steel shank piece to work its way loose from the repetitive flexing of the shoe, causing the shoe to develop a squeak. Another difficulty encountered with preformed steel shanks is "striking through", when the steel shank can be felt by the wearer. Efforts to overcome this have included the addition of sheets or layers of cushioning material (called a "tuck") interposed between the shank and the insole. Here again, this adds to the cost and only further complicates the manufacturing procedure.

Additional difficulties result from the manner in which insoles are manufactured. It is not uncommon for the insoles to be non-uniform in shape. Insoles usually are formed in a process in which the insole is molded in a molding press to a shape which is intended to fit the contour of the bottom of the last. Where the insoles are intended to be used with many identical lasts, variations in the insole shape, from insole to insole, can result in a variety of manufacturing problems as well as considerable difficulties in the quality of the resulting shoes. For example, improperly shaped insoles can result in loose top lines, wavy or wrinkly appearing uppers, poor lasting, misregistration of various shoe parts and the like. While subsequent attachment of a preformed, preshaped shank strip to a misformed or mismolded insole sometimes will tend to correct the insole shape, whether and the extent to which the insole will be so corrected depends in large measure on the care and skill of the operator who attaches the shank. Thus, while an overmolded or undermolded insole might be correctable by precision attachment of a preformed shank of proper curvature and shape, the practicalities of commercial production are such that such precision shank attachment cannot be relied on in most commercial settings. The present invention provides a means which assures that each and every insole will be precisely the same configuration both as to shape as well as to configuration of stiffener.

Prior patents assigned to the assignee of this invention, have described articles, techniques and devices for using initially flexible and deformable shank stiffener elements which, once applied to the bottom of an insole, then can be activated and cured to a hardened, stiff shank element. For example, materials useable for this purpose are described in U.S. Pat. Nos. 4,081,917, issued Apr. 14, 1978 and 4,162,583, issued July 31, 1979. The present invention relates to further improvements in techniques and devices for forming insoles with shanks attached thereto and in which the shanks are attached to the insole before the insole is incorporated into a shoe assembly.

SUMMARY OF THE INVENTION

The invention employs shank strip material which is initially flexible and conformable to the contour of the bottom of a curved shoe insole or the like. The material is available in rope-like form and includes reinforcing fibers impregnated with a thermosetting resin, all encased within an elongate sleeve. In the present invention, the material preferably is stripped of its sleeve to provide a length of resin-impregnated fiberglass. The shank strip then is placed on the insole. The insole and shank strip are held in a predetermined shape while the strip is activated and cured.

The length of impregnated, fiberglass then is placed by the operator on the bottom of an insole. The insole may have been formed previously with a shank-receptive groove. The insole, with shank material located on its bottom, then is inserted into a special fixture which clamps the insole in a predetermined configuration, to assure proper curve at ball and arch, and retains the shank strip in place on the insole bottom. The shank strip then is exposed to a high temperature radiant heater which activates the resin directly in place on the insole bottom.

The fixture for holding the insole and shank strip is movable between a loading position in which it is out of the way of the radiant heater and an activating position in which the fixture is exposed to the heater. An automatic timer is employed to hold the fixture exposed to the heater for a predetermined time interval and then to automatically return the fixture to its loading station where the insole with cured shank may be removed and a fresh insole, loaded with an uncured shank strip, may be inserted.

The fixture for holding the insole and shank strip assures precise repeatable control over the shape of the insole and the shape of the shank strip when cured. The fixture includes means to support the insole, bottom up, at three locations, including the heel, the arch curve and the ball curve. The heel support unit includes a gauge to locate the heel end of the insole. The arch and ball support units each are adjustably movable longitudinally with respect to the heel support and independently of each other. The arch support includes a heightwise adjustable support pad. The ball support includes a longitudinally adjustable support pad. Each of the three support units also includes a hold-down, movable vertically toward and away from its associated supporting surface, so that after an insole is placed on the supports, the hold-downs will engage and clamp the insole (and shank strip) to urge them to the predetermined, preadjusted shape defined by the support pads. The fixture holds the insole and shank strip in the predetermined shape while the shank strip is cured, such as by exposing the assembly to a radiant heater.

It is among the general objects to provide an improved technique for stiffening and shaping insoles before the insoles are mounted on a last or otherwise incorporated into a shoe assembly.

Another object of the invention is to provide a technique for stiffening a plurality of insoles in which it is assured that each insole will have the same configuration as the others.

A further object of the invention is to provide an apparatus for holding an insole in a predetermined configuration while curing a shank strip on the bottom of the insole in which the fixture for holding the insole is adjustable to provide a high degree of control as to the extent of curvature at the arch and ball regions of the insole.

DESCRIPTION OF THE DRAWINGS

The foregoing and other objects and advantages of the invention will be appreciated more fully from the following further description thereof, with reference to the accompanying drawings wherein:

FIG. 1 is an illustration of an insole, bottom up, which has been grooved to receive a shank;

FIG. 2 is an illustration of shank strip material before it is stripped;

FIG. 3 is a transverse sectional view of an insole of the type shown in FIG. 1 having a length of shank strip material on the bottom;

DESCRIPTION OF THE PREFERRED EMBODIMENT

Figure 4:
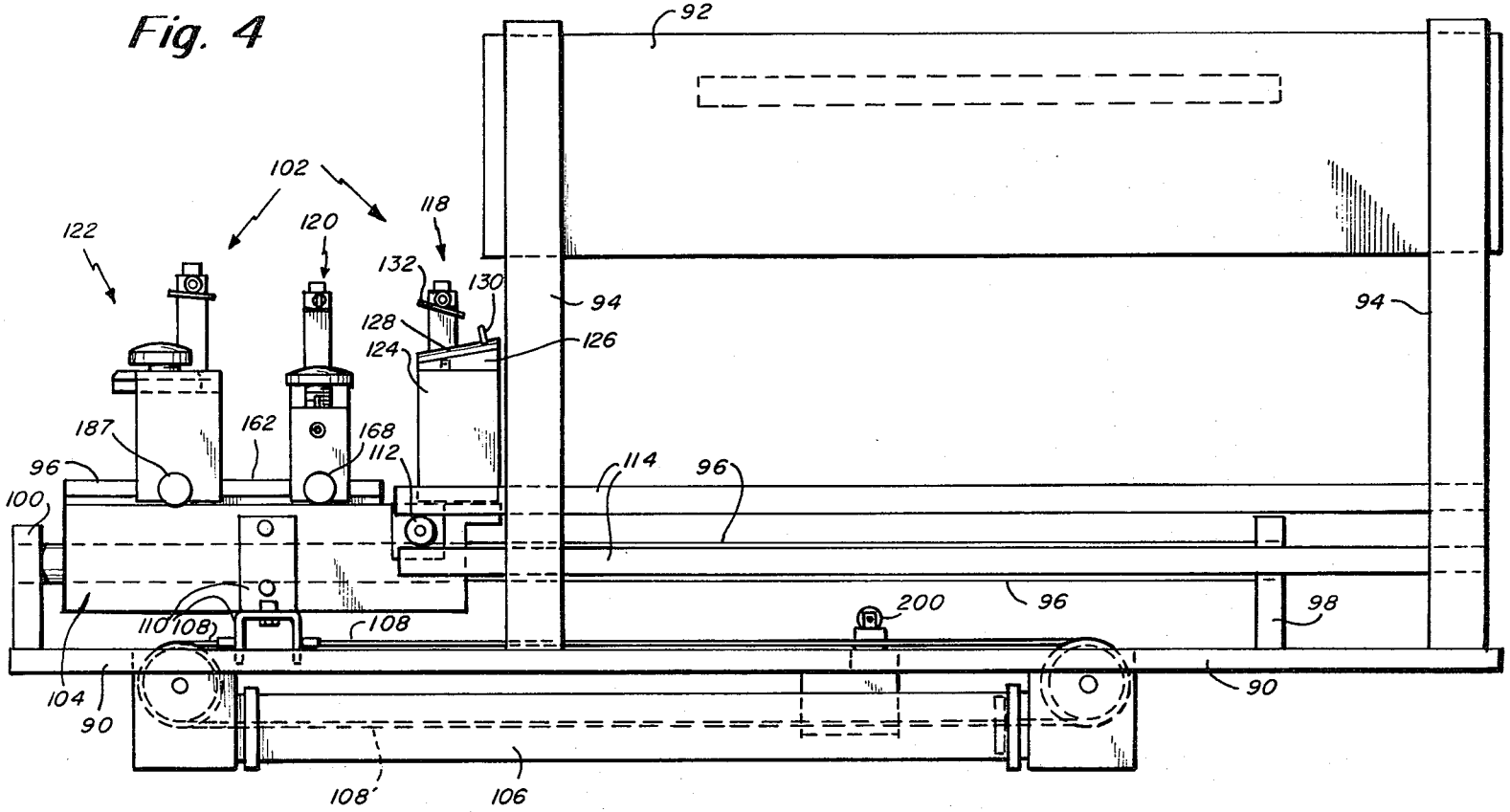
FIG. 4 is a side elevation of the shank attaching and insole shaping device.
Figure 5:
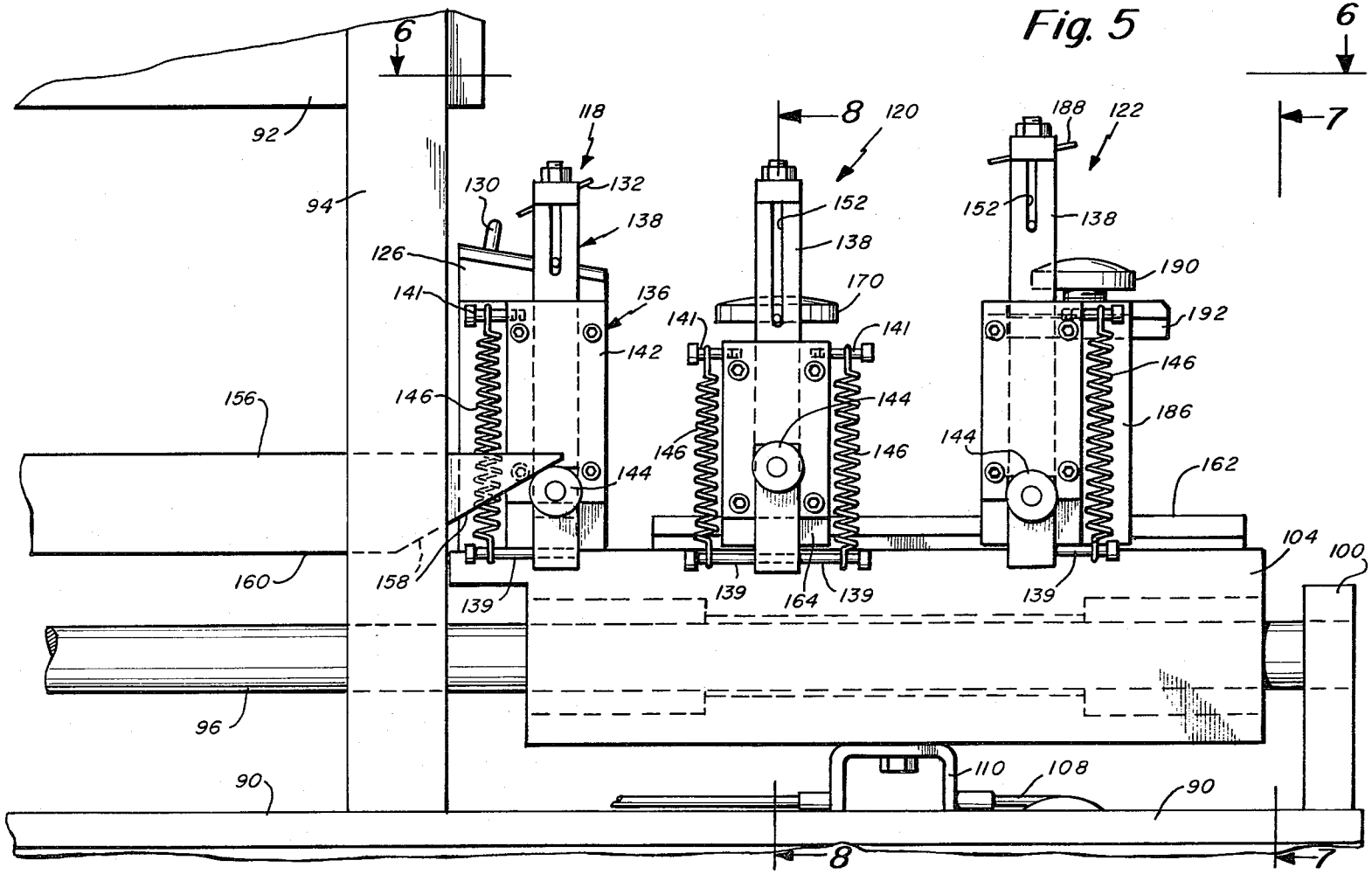
FIG. 5 is an enlarged side elevation of a portion of the device shown in FIG. 4, as seen from the opposite side thereof and illustrating the fixture.

FIG. 1 illustrates an insole 10 (bottom-up) which typically will have a curve at its ball region 12 and a curved shank region which defines an arch 14. The curve of the arch is in the opposite direction than the curve of the ball 12. The insole 10 typically is made up of a number of sheets of material pressed and bonded together. For example, the portion of the insole extending rearwardly from the ball region often is made from two layers 10*a*, 10*b* of stiff fibrous board and may be as much as 3/16 to ¼ inch thick. Usually, the insole will have been precut from a strip of composite material and then will have been premolded to a shape which is intended to conform to the contour of the bottom of the last. As mentioned above, the insole molding procedures often are such that the insoles are not of uniform contour, it being among the objects of the present invention to provide a means by which such errors in molding contour of the insoles can be corrected with repeated accuracy.

As illustrated in FIG. 1, the bottom of the insole 10 may be formed with a groove 16 to receive the shank stiffener. The groove 16 may be of a depth approximately half and perhaps slightly more than half of the thickness of the arch portion of the shank (see FIG. 3). The groove 16 may extend from the heel seat region to approximately the ball region, the precise length of the groove being somewhat a function of the intended length of the shank. It should be noted, however, that the present invention may be used with ungrooved insoles as well. Also with the present invention, the length of the shank may be controlled as the manufacturer desires and can be adjusted easily.

FIG. 2 illustrates a commercially available form of the shank material useable in accordance with the present invention. The material is available in rope form and includes a sleeve 18 which contains elongate fiberglass reinforcing fibers 20 and a matrix of thermosetting resin 22, activatable by heat or other external stimulus. The sleeve 18 may have margins 24 which facilitate gripping and manipulation of the sleeve 18 in other systems, such as, for example, that disclosed in U.S. Pat. No. 4,161,048, issued July 17, 1979.

In accordance with the illustrative embodiment of this invention, the sleeve 18 is stripped from the resin impregnated fiberglass and a strip of the impregnated material is severed. The strip 26 of severed material is placed in the groove 16 of the insole and may be reshaped during the process, for example as illustrated in FIG. 3. The material is easily conformable to the contour and curves of of the bottom of the insole which is itself somewhat flexible at this point. When the strip has been placed on the insole bottom or in the groove 16, the insole and strip then are placed in the molding and curing device (FIG. 4) to shape the insole and cure the shank strip.

The apparatus for shaping the insole and activating the shank strip while the insole is maintained in its preshaped condition is illustrated in FIGS. 4–11. The various elements of the device are mounted to and about a platform 90. A radiant heater 92 is mounted above the platform 90 by a plurality of legs 94 which extend upwardly from the platform 90. Also mounted to the platform 90, but below the radiant heater 92, is a longitudinally extending guide rod 96. The guide rod 96 is supported by a pair of brackets including a rear bracket 98 and a front bracket 100, both of which are secured to the platform 90. The guide rod 96 extends from a rearward location, fully below the heater 92 to a forward location well beyond the forward end of the radiant heater 92.

The guide rod 96 carries and guides the insole fixture, indicated generally by reference character 102. The insole fixture 102 includes a carriage 104 which moves linearly along the guide rod 96. The carriage 104 is driven by a cable cylinder 106 which is mounted beneath the platform 90 and which has an endless cable 108 connected to the piston in the cylinder 106 and to the carriage 104, as by a bracket 110. The cable cylinder 106 is operated to move the insole fixture 102 between a forward position (shown in FIG. 4) in which the fixture may be loaded and unloaded, and a rearward, working position in which the fixture is disposed below the radiant heater 92.

The insole fixture 102 is maintained in a secure, upright position and is precluded from rotating about the guide rod 96 by a guide roller 112 which is attached to and extends transversely from the carriage 104. The guide roller 112 rides between a pair of parallel guide rails 114 which are secured to the legs 94 on one side of the machine.

The insole fixture 102 includes means for supporting the insole at three locations. The fixture includes a heel support unit 118, an arch support unit 120 and a ball support unit 122. Each support unit also includes an overhead pressing member which bears downwardly on the underlying portion of the insole to urge that portion of the insole against its respective supporting surface. As will be described below in further detail, various adjustments can be made to the relative locations of the support units to control the shape of the insole and shank stiffener.

Figure 9:
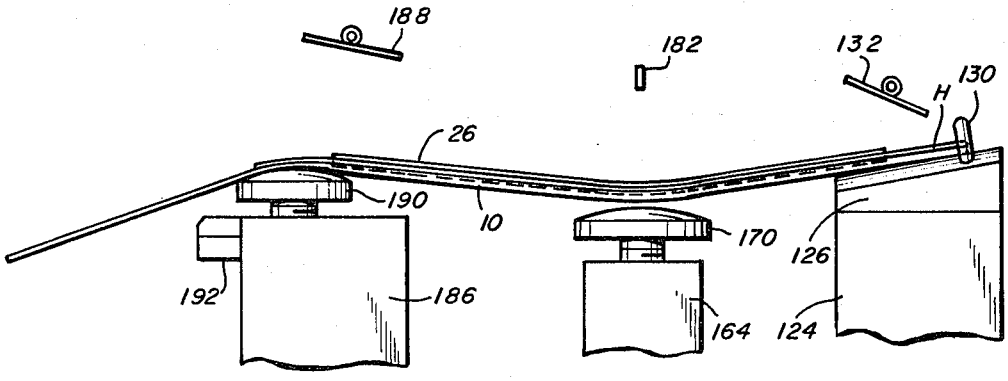
FIG. 9 is a somewhat diagrammatic illustration of an undermolded insole when first placed in the fixture but before the insole is clamped in the fixture.
Figure 10:
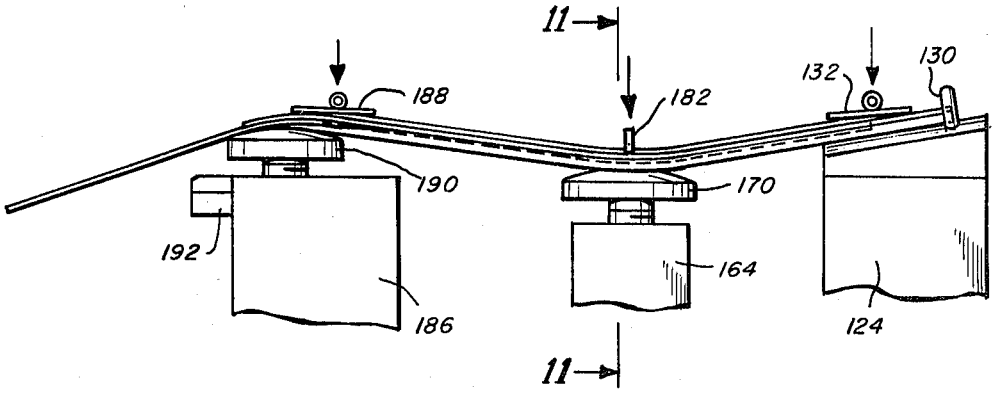
FIG. 10 is an illustration of the insole of FIG. 9 when the fixture is clamped.
Figure 11:
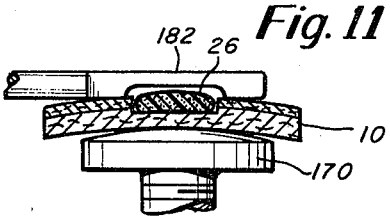
FIG. 11 is an illustration of the manner in which the arch curve is clamped, as seen along the line 11—11 of FIG. 10.

The heel support unit 118 is illustrated further in FIGS. 9–11 and includes a heel block 124 which is secured to the rearward end of the carriage 104. The upper end of the heel block 124 carries a heel support pad 126 which has an upper surface 128 which is inclined downwardly and forwardly. A pair of pins 130 extend upwardly from the rear end of the heel support pad 126 and provide a guide against which the heel end of the insole may be abutted, as suggested in phantom at H in FIG. 6. Engagement of the heel end of the insole with the pins 130 provides a reference location for the heel of the insole. The downward and forward inclination of the upper surface 128 of the heel support pad 126 is selected to approximate an average range of attitudes of the heel end of the insole of most shoes (see FIG. 10). However, in the case of extremely high-heeled shoes, it may be desirable to have more of any inclined upper surface 128 and, to that effect, heel support pad 126 may be changed to one having a more steep incline. For that purpose, the heel support pad 126 may be detachably mounted to the block 124 by any convenient means.

Figure 6:
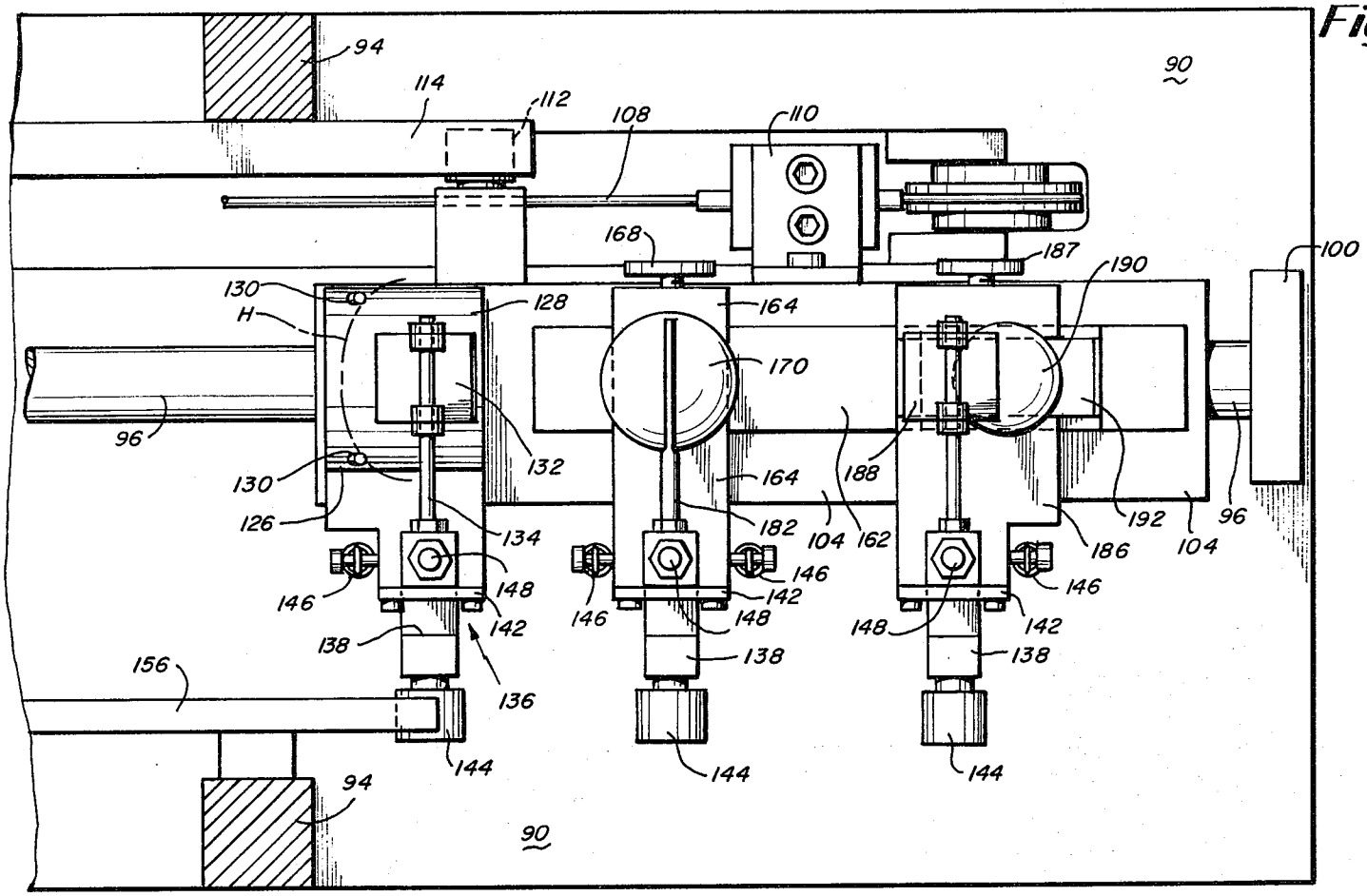
FIG. 6 is a top plan view of the fixture as seen from line 6—6 of FIG. 5.
Figure 7:
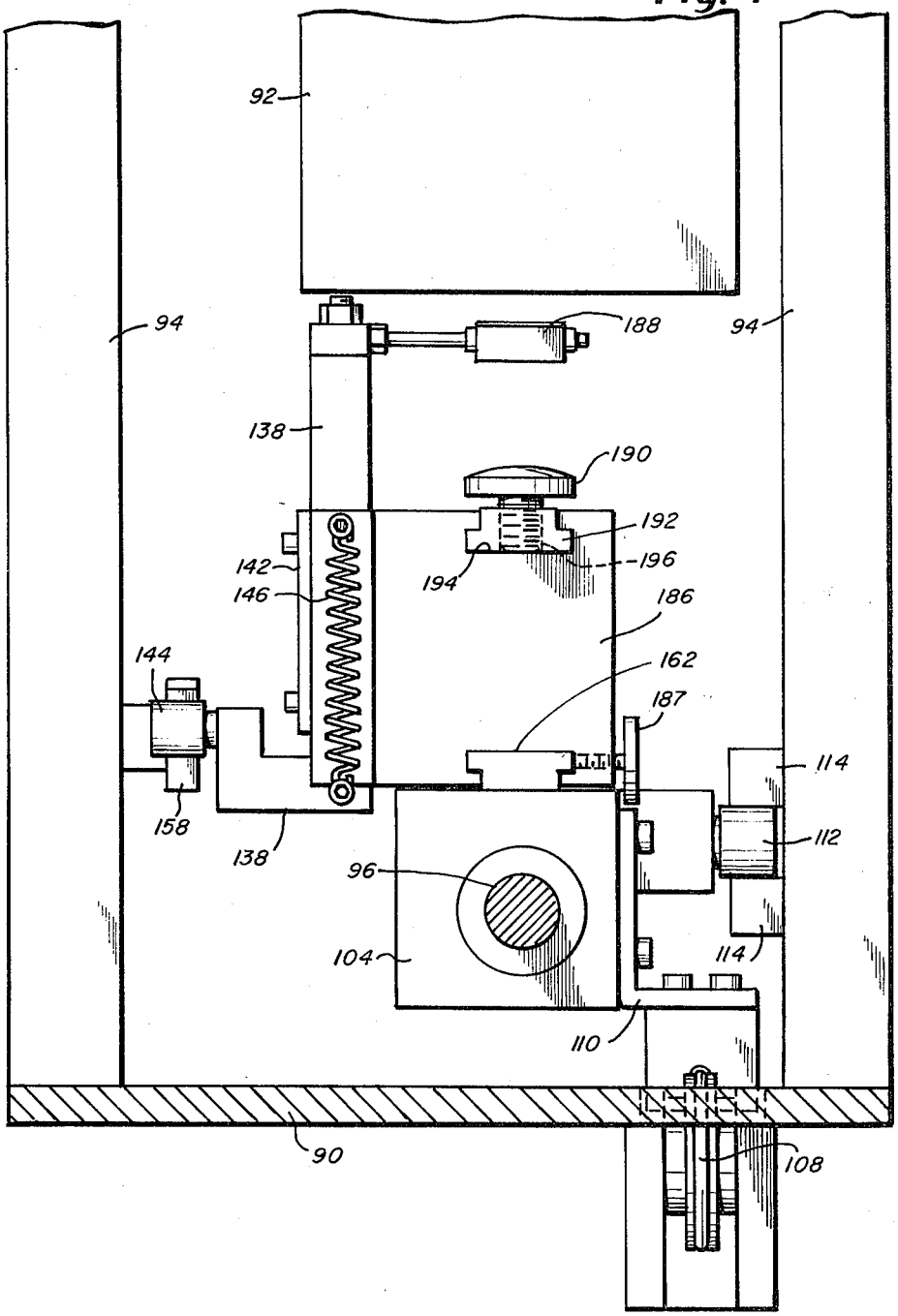
FIG. 7 is an illustration of the device as shown in FIG. 5 as seen along the line 7—7 of FIG. 5.

The heel support unit 118 also includes a heel presser pad 132 which is normally spaced above the heel support pad 126. The presser pad 132 is pivotally mounted about a transverse, horizontal axis which is defined by a transversely-extending pin 134 (FIG. 6). Means are provided to move the heel presser pad 132 downwardly toward the heel support pad 126 to press the heat seat portion of an insole firmly and downwardly against the heel support pad 126. This serves to hold the heel end of the insole firmly and also to press the shank strip in the heel region firmly against the insole. It also may be noted that in the illustrative embodiment, the groove 16 (FIG. 1) in the insole gradually reduces in depth at its ends. The presser pad 132 applied to the heel end of the shank strip tends to flatten and feather the heel end of the shank strip, causing the fiber ends to spread out with a smooth and gradual transition to a feathered surface.

The heel presser pad 132 is mounted for heightwise movement toward and away from the heel support pad 126 by a vertically movable slide mechanism, indicated generally at 136. Each of the support units 118, 120, 122 has a substantially identical slide mechanism 136 and is the following description the elements of the slide mechanism 136 of each support unit will be considered to have like reference characters. The slide mechanisms 136 each include a vertical slide member 138 which is guided for vertical slide movement within a vertical guide slot 140 (FIG. 8) formed in the its respective block, such as the heel block 124. A cover plate 142 captures the vertical slide 138 and retains it in the guide slot 140. The lower end of the vertical slide 138 extends downwardly below its supporting block (e.g. heel block 124) and has a cam roller 144 rotatably attached. As will be described below, the cam roller 144 engages a camming surface in response to rearward movement of the insole fixture 102 to a guide and urge the vertical slide 138 downwardly. The slide 138 is maintained in a normally upward position by one or more tension springs 146 (not shown in FIG. 8) connected at one end to the lower end of the vertical slide 138 by the pin 139 and at their upper ends to the heel block 124 as by pins 141.

Figure 8:
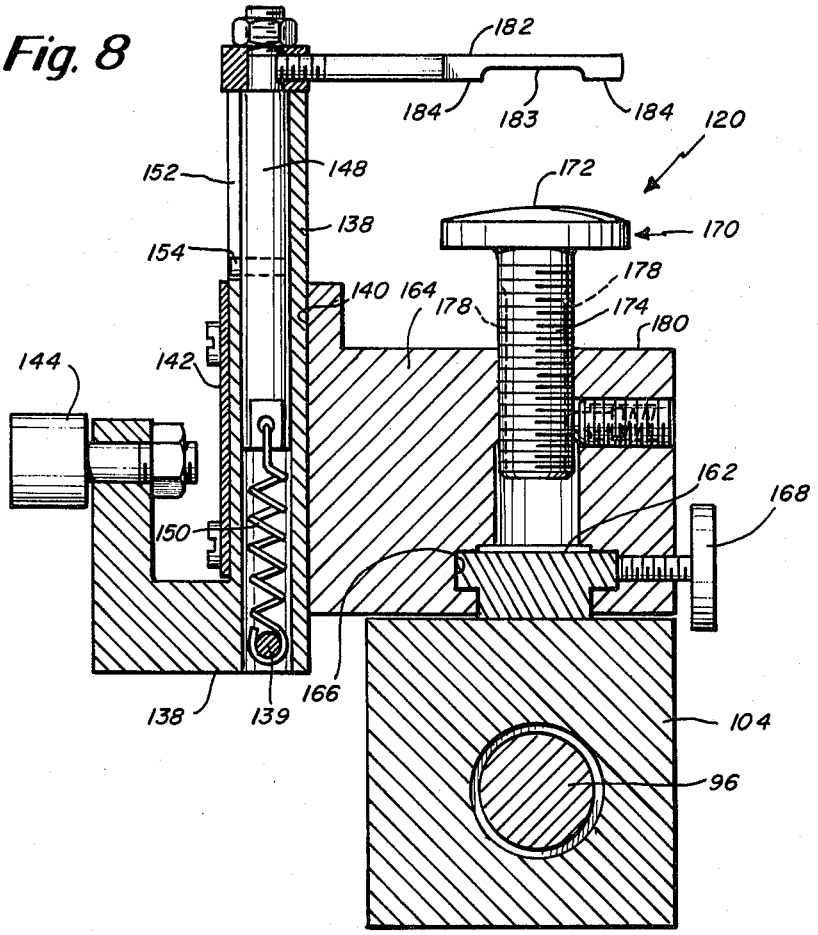
FIG. 8 is an enlarged sectional illustration of the arch support unit as seen along the line 8—8 of FIG. 5.

The pin 134 which carries the heel presser pad 132, is carried by the vertical slide 138 in a lost motion connection which enables the vertical slide 138 to continue to move downwardly even after the heel presser pad 132 has engaged fully the heel seat of the insole. Thus, as shown in FIG. 8, the vertical slide 138 is hollow and receives a downwardly extending telescoping rod 148. The lower end of the telescoped rod 148 is connected by a spring 150 to the pin 139 which is secured to the lower end of the vertical slide. The spring 150 maintains the vertical slide 138 and telescoping rod 148 and their fully collapsed and telescoped configuration. In order to prevent the inner telescoping rod 148 from rotating within the vertical slide 138, the vertical slide is provided with a vertical slot 152 which receives a pin 154 connected to the inner telescoping member.

The cam roller 144 on each support unit is aligned with a cam bar 156 (See FIGS. 10 and 11) which extends longitudinally and rearwardly in the machine and is supported by two of the legs 94. The cam bar 156 has an initial downwardly and rearwardly inclined cam surface 158 which will guide the cam roller 144 to the underside horizontal surface 160 of the cam bar 156. Thus, when the insole fixture 102 is advanced rearwardly by the cable cylinder 106, the cam roller 144 will advance fully, rearwardly and downwardly along the camming surface 158 to bring the vertical slide 138 of the heel support unit downwardly and bring the heel presser pad 132 firmly into engagement with the heel seat region of the insole. Firm engagement of the heel seat presser pad 132 with the insole is assured by the lost motion connection between the slide 138 and rod 148, described above. The parts are dimensioned so that the heel presser pad 132 will be in full engagement with the heel seat of the insole before the cam roller 144 has reached the bottom surface 160 of the cam bar 156.

The arch support unit 120 and the ball support unit 122 are mounted to the carriage 104 for adjustable longitudinal movement. The arch support unit 120 and ball support unit 122 may be moved on the carriage 104 to any of a variety of positions with respect to each other and with respect to the heel support unit 118. The arch and ball support units 120, 122 each are mounted to the main block 104 by a gib 162 which is T-shaped in cross section and which is secured to the upper surface of the main block 104. The longitudinal adjustment of the arch and ball support units 120, 122 enable the device to be used with a wide range of insole sizes and heel heights and provides for reliable, repeatable control over the shape of the insole, as will be described.

The arch support unit 120 includes an arch support block 164 which has a T-shaped slot 166 at its bottom end to receive the gib 162 (See FIG. 8). The arch support block 164 may be secured in any position along the gib 162 by a manual locking screw 168. An arch support pad 170 is threaded into the top of the arch support block 164 and has a curved upper surface 172 which serves as a support for the arch region of the insole. The height of the arch support pad 170 is adjustable over a considerable range simply by turning the arch support pad 170 to screw it in or out of the block 164. The outer periphery of the pad is knurled It also is desirable to provide detents at each 180 degrees of rotation of the arch support at 170 to assure that once it is set for a particular height, it will remain at that height. To that end, the screw portion 174 of the pad 170 is provided with a pair of diametrically opposed longitudinal slots 178. A spring biased detent ball unit 180 is threaded into the block 164 and serves to releasably engage the slots 178 in a spring-detent action.

The arch support unit 120 includes the same vertical guide and lost motion mechanisms as described above. The arch support unit 120, however, does not include a broad presser pad as do the heel and ball support units 118, 122. Rather, it is preferred to avoid firm pressure on the arch portion of the shank strip. To that end, the arch support unit 122 includes a relatively slender blade 182 which extends from the upper end of its associated telescoping member 148 over the center of the arch support pad 170. The blade 182 has an undercut portion 183 slightly wider than the expected width of the shank strip. The undercut 183 defines a pair of feet 184 which engages the insole in the arch region but on opposite sides of the shank strip. As will be described, the feet 184 press firmly on the insole, but no more than very light pressure is applied to the shank strip 26 by the blade 182.

The ball support unit 122 is constructed similarly to the arch support unit 120 in that it has a ball support block 186 (FIG. 7) which is slideably positioned on the gib 162 and which can be secured in place by a locking screw 187. The construction of the vertical slide mechanism is substantially the same as described above in connection with the heel and arch support units. The ball support unit, like the heel support unit, carries a ball presser pad 188. The ball support unit also carries a ball support pad 190 which is smaller than but generally similar to the arch support pad 170. The ball support pad 190, however, also is carried for adjustable longitudinal movement with respect to the ball presser pad 188. To this end, the ball support pad 190 is threaded into a slide 192 which is slideable longitudinally within a slot 194 formed in the upper end of the ball support block 186. The end of the screw 196 portion of the ball support pad 190 presses downwardly against the bottom surface of the slot 194 to selectively lock the ball support pad in any desired longitudinal position on the ball support block 186.

With the foregoing combination of adjustable features of the arch support 170 (longitudinal and heightwise) and ball presser pad 188 (longitudinal) and ball support 190 (independent longitudinal) practically any insole can be accommodated by the fixture 102. Moreover, variations in lengths of shanks in any particular insole can be utilized depending on the desires of the manufacturer. For example, in some instances, it may be desirable to terminate the shank in the ball region but heelwardly of the ball in which case the relative location of the ball presser pad and ball support pad would be suitably adjusted. Suitable adjustments can be made for any configuration desired.

In operation, a predetermined length of shank material 26 is provided from the stripping and cutting device by actuating the motor M to deliver a predetermined length of shank material 26. The operator then will place the shank material on the insole bottom generally along the location of the intended shank. In an insole which has been preformed with a shank-receptive groove 16, the operator simply places the shank strip 26 in the groove. The operator may flatten the strip 26 as desired. The insole, with the shank strip in place, then is loaded onto the fixture 102, as illustrated in FIG. 9 and as described in further detail below. The insole is loaded on the fixture while the fixture is in its forward position illustrated in FIG. 4. In this position, the slides 136 of the various support units are in their raised positions, as biased by the tension springs 146 so that the heel presser pad 132, ball presser pad 188 and arch hold down 182 are in their raised positions. The insole is loaded onto the fixture, bottom up, with its heel portion H resting on the heel support pad 126 and with the periphery of the heel in enggement with the pins 130. This locates the insole in a precise and correct longitudinal position in the fixture.

The fixture 102 is adjusted for a particular run of insoiles, by first adjusting the longitudinal position of the ball presser pad 188 with respect to the ball end of the shank strip 26. Thus, with an insole located properly on the heel support pad 126, in engagement with the pins 130, the locking screw 187 is released to enable the entire ball support 122 to be shifted longitudinally to a position in which the ball presser pad 188 will be located above the ball end of the shank strip 26. The heel presser pad 132 is not adjustable. Alignment of the heel presser pad 132 with the heel end of the shank strip 26 is assured by the operator when he initially places the shank strip 26 on the insole bottom to first locate the heel end of the shank strip at the proper lengthwise location on the insole bottom.

With the ball presser pad 188 properly located, the ball support pad 190 then is adjusted to a position at the ball curve to support the ball of the insole. The longitudinal position of the ball support pad 190 is adjusted by loosening the pad 190 to enable the slide 192 to be shifted longitudinally. When the pad 190 is in proper position at the ball curve region of the insole it is retightened. The longitudinal adjustment of the ball support pad 190 thus is independent of the longitudinal positioning of the ball presser pad 188.

The independent longitudinal adjustment of the ball presser pad 188 and ball support pad 190 assure that the insole will be supported properly at the ball curve and the presser pad will engage and overlie the ball end of the shank strip 26, regardless of the precise location of the ball end of the shank strip. In this regard, FIGS. 14 and 15 illustrate a shank strip 26 in which the ball end terminates slightly short of the ball curve. The longitudinal position of the presser pad 188 is slightly rearwardly of the ball curve and of the ball support pad 190. As can be seen from FIG. 10, when the ball presser pad 188 has been brought downwardly to its clamping position, it still cooperates with the ball support pad 190 to grip and retain the insole while pressing and feathering the ball end of the shank strip 26. Similarly, the fixture may be adjusted to use shank strips which terminate precisely at the ball curve or even forwardly beyond the ball curve. The ability to easily vary the length of a shank stiffener while assuring proper conformity and attachment of the stiffener to the shank insoile is a very desirable feature in shoemaking.

After the ball support unit 122 has been set up, the arch support unit then is adjusted to the proper longitudinal and heightwise position. The block 164 is positioned along the gib 162 so that the arch support pad 170 is located directly below the arch curve. Once the longitudinal position of the arch support unit 120 has been set, the arch support pad 170 then is raised or lowered to the desired height. The height of the arch support pad 170 has a direct effect on the extent of curve which will result in the arch region which, in turn, will have an effect on the extend of curve at the ball region of the insole in the completed shoe. Shoes which are to have high heels necessarily will require a sharper arch curve and ball curve than shoes having lower heels.

Once the arch and ball support units have been adjusted properly to provide datum locations to support the insole, the system is ready to receive a run of insoles, with the assurance that each will be clamped to and against the predetermined datum points to assure that the insole will follow a predetermined contour. During a production run, an insole with shank strip 26 applied to its bottom is placed in the fixture with its heel in engagement with the pins 130. Whether the insole naturally contacts all three datum points (heel support, arch support and ball support) when the insole is in its relaxed state will depend on whether the insole was originally molded to the precisely intended configuration, or whether the particular insole may have been undermolded or overmolded. If undermolded, the arch curve of the insole will remain spaced above the arch support pad 170, the insole being supported at its heel and ball regions only. If overmolded, the insole will be supported by the arch support pad 170 and one of the ball support pads 190 or heel support 126. Of course, as described above, whether the insole was initially undermolded, overmolded or properly molded is of no concern when the present invention is used because the fixture 102 compensates for any errors in the molding of the insole by providing precise datum points at critical regions of the insole.

The operator loads the fixture by placing the heel end of the insole on the fixture. The operator may manually guide the insole to assure that the insole remains in contact with the heel pins 130, at least until the heel presser pad 132 has gripped and clamped the heel end of the insole-shank strip unit. When the operator is assured that the heel end of the insole is properly located, the operator then actuates the cable cylinder 106 by an appropriate valve (not snown). The cable cylinder 106 drives the carriage 104 along the guide rod 96, toward a position beneath the radiant heater 92. As the carriage advances rearwardly, the roller 144 associated with the heel support unit 118 is guided downwardly as it advances along the cam surface 158 of the cam bar 156. That draws the slide 138 of the heel support unit 118 downwardly and brings the heel presser pad 132 into firm contact with the heel seat region of the insole to clamp the insole and to press the heel end of the shank strip 26 firmly against the insole bottom in a feathered configuration. Once the heel region of the insole has been clamped, the operator then may release the insole which will remain properly positioned as the carriage 104 continues to advance.

As the carriage 104 continues to advance, the cam roller 144 associated with the arch support unit 120 engages the downwardly inclined cam surface 158 which draws the arch holddown 182 downwardly into engagement with the insole. The arch holddown urges the arch curve of the insole firmly into engagement with the arch support pad 170, to define precisely a second datum point of reference. As shown in FIG. 11, the arch holddown preferably acts primarily on the insole itself and does not apply a firm pressure to the arch curve portion of the shank strip 26. It is preferable that the shank strip 26 be free of any crease or narrowing in cross section which might adversely effect the ultimate strength of the shank when cured. By engaging firmly only the insole in the arch region, it is assured that the cross sectional shape of the cured shank will remain uniform and without any stress points which might result from creases or the like.

Continued advancement of the carriage brings the cam roller 144 of the ball unit 122 into engagement with the cam surface 158 to draw the ball presser pad 188 downwardly to the position shown in FIG. 10. When the carriage 104 has been advanced fully by the cable cylinder 106, all of the cam rollers 144 will be in engagement with the horizontal underside 160 of the cam bar 156, with all of the presser pads and holddowns firmly maintaining the insole at its predetermined datum points while maintaining the shank strip in proper location along the insole bottom, following the curved contour of the insole, as defined by the datum. At that position, the fixture will have carried the insole beneath the radiant heater 92. The fixture remains beneath the radiant heater 92 for a time which may be controlled by a timing and valving device which, after a predetermined interval, will reshift the cable cylinder 106 to return the carriage 104 to its initial loading position. The device preferably is provided with a switch, indicated at 200 (FIG. 4) which is actuated by the carriage 104 as th carriage advances beneath the heater 92. The switch begins operation of the timer to control the reshifting of the cable cylinder 106 and thereby the duration of exposure of the insole bottom and shank strip to the radiant heater. In the preferred embodiment of the invention, the radiant heater may be left on continuously. Alternately, if desired, operation of the switch 200 also may be used to control operation of the radiant heater 92.

It should be noted that the presser pads 132, 188 overlie the heel and toe ends of the shank strip 26 and shade the ends from direct exposure to the radiant heater 92. In order to assure proper curing of the ends of the shank strip 26, the presser pads 132, 188 preferably are darkened so as to absorb energy from the radiant heater 92 and to conduct that heat energy directly to the ends of the shank strip 26. The arch holddown 182 is slender and does not interfere with activation of the arch curve region of the shank strip 26.

It is preferable to expose the shank strip 26 at a temperature just sufficient to activate the resin and to maintain the insole under the radiant heater 92 for an extended period of time, for example, of the order of 30 seconds. This has been found preferable to a short duration high temperature exposure and assures the insole will not be damaged. In addition, it has been found that heating of the insole during the shank strip activating process tends to disrupt the elastic memory the insole may have had. The insole is easily free to conform to the curvature defined by the three datum points and the shank strip 26 similarly is free to conform to the contour of the insole bottom. Thus, the insole itself is set up to serve as a molding surface against which the shank strip 26 is formed. When the insole with cured stiffener is removed, the shank strip stiffener maintains the insole at its proper curvature as well as serving as a conventional shank stiffener when the insole is incorporated into a shoe assembly.

It should be understood that the foregoing description of the invention is intended merely to be illustrative thereof and that other modifications and embodiments may be apparent to those skilled in the art with departing from its spirit.

Having thus described the invention, what I desire to claim and secure by Letters Patent is:

1. A method for shaping an insole to a predetermined shape and for stiffening the shank region of the insole in said predetermined shape comprising:

providing an insole which has been pre-molded to a shape which substantially approximates said predetermined shape;

holding at least selected regions of the pre-molded insole in said predetermined shape;

while so holding the insole, causing an initially flexible, externally activatable material on said shank region of the insole to cure to a rigid state while on the insole and to adhere to the insole;

whereby the externally activatable material will cure and conform to said predetermined shape and will, when cured, retain the shank region of the insole in said predetermined shape.

2. A method as defined in claim 1 wherein the step of holding the insole comprises holding the insole to provide a predetermined degree of ball curve and a predetermined degree of arch curve.

3. A method as defined in claim 1 wherein the selected region of the insole comprises the shank region and wherein the material comprises a shank strip formed from a plurality of reinforcing fibers impregnated with a thermosetting resin.

4. A method as defined in claim 3 wherein the shank strip is applied to the insole while the shank strip is in a flexible state to be held on the insole in said predetermined configuration; and holding the shank material against the insole while curing the material.

5. A method as defined in claim 1 further comprising providing at least three datum surfaces for support of the insole in said predetermined shape and holding said selected regions against the datum surfaces while the activatable material cures.

6. A method as defined in claim 1 wherein said step of curing further comprises permitting said externally activatable to cure to its rigid state without the influence of externally applied molding pressure.

7. A method of defining claim 4 wherein said step of curing further comprises permitting said externally activatable to cure to its rigid state without the influence of externally applied molding pressure.

8. A method as defined in claim 3 further comprising:

forming a slot in the shank region of the insole to partially receive said shank strip.

9. A method as defined in claim 4 further comprising:

forming a slot in the shank region of the insole to partially receive said shank strip.

10. A method for imparting a permanent predetermined shape to an insole at the ball and arch curves comprising:

supporting the insole in said predetermined shape with predetermined curves at the ball and the arch;

causing an externally activatable material to cure to a hardened state on the shank region of the insole and to adhere thereto while maintaining the insole in the predetermined shape whereby curing of the material will reinforce the insole and will retain the insole in the predetermined shape in readiness for subsequent shoe manufacturing operations; and heating the insole to disrupt its elastic memory and effecting said curing while the insole is maintained in its heated state.

11. A method as defined in claim 10 wherein said step of curing further comprises permitting said externally activatable to cure to its rigid state without the influence of externally applied molding pressure.

12. A method for reinforcing the shank region of a sole insole with a shank stiffener and for shaping said insole to a predetermined longitudinally extending shape comprising:

providing a pre-molded insole having a molded shape which substantially approximates the predetermined longitudinal shape;

placing a flexible, deformable shank strip on the surface of the shank region of the insole, the shank strip being formed from an activatable resin;

supporting the insole at the heel, ball and arch regions by supporting means arranged to support each region at a predetermined heightwise datum relative to the others, said datum each being disposed along and defining portions of said predetermined longitudinal shape;

confining the insole against said predetermined datum locations to confine the insole to said predetermined longitudinal shape; and activating the shank strip while the insole is so held to cause the strip to cure on and adhere to the insole whereby, when cured, the shank strip will retain the insole in said predetermined longitudinal shape.

13. A method as defined in claim 12 further comprising:

said step of supporting the insole coprising providing a supporting surface for each of the heel, ball and arch regions of the insole and placing the insole on said supporting surfaces with the insole bottom up;

said step of confining the insole against the predetermined datum location comprising holding down the insole to urge the insole at each of the heel, ball and arch regions against the supports therefor;

simultaneously holding down the shank strip to maintain the shank strip in conformity to the curve of the insole along the length of the shank region.

14. A method as defined in claim 13 wherein said step of holding down the shank strip comprising:

holding the ball and heel ends of the shank strip firmly against the insole bottom.

15. A method as defined in claim 12 wherein said step of curing further comprises permitting said externally activatable to cure to its rigid state without the influence of externally applied molding pressure.

16. A method as defined in claim 12 further comprising:

forming a slot in the shank region of the insole to partially receive said shank strip, said shank strip being placed within said slot.

17. A method for repeatedly shaping a plurality of insoles to a predetermined longitudinal shape and for stiffening the shank region of said insoles in said predetermined longitudinal shape comprising:

providing a plurality of pre-molded insoles having molded shapes which substantially approximate said predetermined longitudinal shape;

providing at least three longitudinally spaced datum surfaces arranged to define said predetermined longitudinal shape of the insole;

holding selected regions of the insole against said datum surfaces thereby to hold the insole in said predetermined longitudinal shape;

while so holding the insole, causing an initially flexible, externally activatable material to cure to a rigid state on the shank region of the insole and to adhere to the shank region of the insole whereby the material will cure to said predetermined configuration and will, when cured, retain the insole in said predetermined longitudinal shape;

removing said insole with cured, adhered material from said datum surfaces;

applying another of said pre-molded insoles to said datum surfaces in readiness to shape said insole to said predetermined longitudinal shape.

* * * * *